United States Patent [19]

Van Gompel

[11] 4,057,274

[45] Nov. 8, 1977

[54] METHOD AND APPARATUS FOR BRACING AND SECURING DOORS

[75] Inventor: James J. Van Gompel, Fremont, Ind.

[73] Assignee: Brammall, Inc., Angola, Ind.

[21] Appl. No.: 727,400

[22] Filed: Sept. 29, 1976

[51] Int. Cl.[2] ..... E05C 7/04

[52] U.S. Cl. ..... 292/259 R; 292/252

[58] Field of Search ..... 292/259, 260, 252, 307, 292/339, DIG. 15, 338

[56] References Cited

U.S. PATENT DOCUMENTS

| | | | |
|---|---|---|---|
| 1,174,278 | 3/1916 | Prier | 292/259 X |
| 1,779,491 | 10/1930 | Rau | 292/259 |
| 2,739,729 | 3/1956 | Jonas | 292/259 X |
| 2,741,938 | 4/1956 | Johnson | 85/5 R |
| 3,186,196 | 6/1965 | Moberg | 292/252 X |
| 3,768,849 | 10/1973 | Sytko | 292/327 |
| 3,821,884 | 7/1974 | Walsh | 292/259 |
| 3,951,443 | 4/1976 | Barnaby | 292/327 |

*Primary Examiner*—Richard E. Moore

*Attorney, Agent, or Firm*—Hill, Gross, Simpson, Van Santen, Steadman, Chiara & Simpson

[57] ABSTRACT

An apparatus for bracing and securing entrance doors to a storage area has a bracing means detachably connected within the storage area adjacent the door. A free end of a retainer member is aligned through an aperture in the door and pushed into a locking means mounted adjacent the aperture on the bracing means. The free end of the retaining member is slidably engaged in a locking means as it is pushed therein. The locking means locks to the free end of the retaining member when an attempt is made to withdraw said member.

11 Claims, 11 Drawing Figures

METHOD AND APPARATUS FOR BRACING AND SECURING DOORS

BACKGROUND OF THE INVENTION

1. Field of the Invention

This invention relates to a bracing and security apparatus for doors and more particularly to a security apparatus which is difficult to remove after installation, except with the proper tools.

2. Description of the Prior Art

The unauthorized removal of merchandise from storage areas, either fixed or mobile, has been a continuing problem. The prior art security devices are expensive and difficult to install. Furthermore, it is desirable to provide a security device which will clearly indicate that an unauthorized entry has occurred to investigators analyzing a break-in.

SUMMARY OF THE INVENTION

It is an object of the present invention to provide a method and apparatus for bracing and securing an entrance door to a storage area which is inexpensive and yet simple to install.

It is a further object of this invention to provide an apparatus and method for bracing and securing entrance doors to a storage area whereby any unauthorized tampering with the security apparatus will be detectable.

In the present invention, a door bracing and securing apparatus is provided for a storage area closure means wherein a bracing means is connected by a detachable connecting means within the storage area adjacent the closure means. An aperture is provided through the closure means for receiving a free end of a retaining member and the other end of the retaining member has a flag member or enlarged knob attached thereto, as by crimping or fusing. A locking means is mounted in a closure on the bracing means and slidably engages the free end of the retaining member when it is aligned through the closure means and pushed into the locking means. The locking means locks to the free end of the retaining member when an attempt is made to pull the retaining member away from the locking means.

DESCRIPTION OF THE PREFERRED EMBODIMENTS

Figures 1, 2, 3, 4, 5:
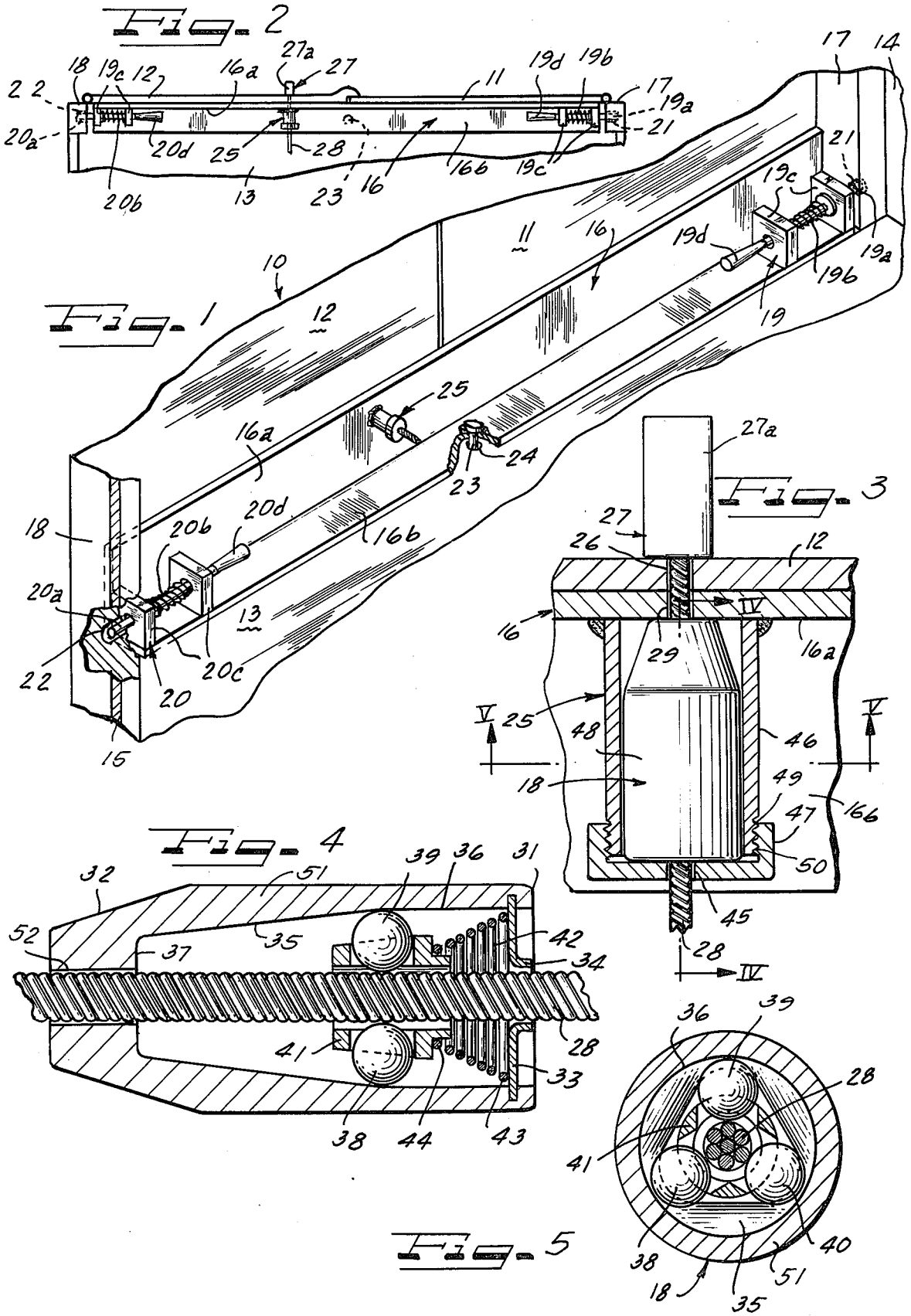
FIG. 1 is a perspective view illustrating a bracing and securing apparatus of this invention.
FIG. 2 is a top view of the apparatus of this invention.
FIG. 3 is a side view illustrating in detail a locking means holder of this invention.
FIG. 4 is a cross sectional view taken along line IV—IV of FIG. 3.
FIG. 5 is a cross sectional view taken along line V—V of FIG. 3.

An apparatus for bracing and securing the entrance door to a storage area is shown generally at 10 in FIG. 1. Horizontally swinging doors 11 and 12 are provided for entrance to a storage area comprising a floor 13 and vertical side walls 14 and 15 to which doors 11 and 12 are hinged. It should be understood, however, that the device is equally useful with one or more vertically swinging doors.

An elongated L-shaped bracing bar 16 is provided on the floor 13 adjacent the doors 11 and 12. The bar 16 has a vertical flange **16*a* and a horizontal flange 16*b*. Corner posts 17 and 18 are respectively connected to side walls 14 and 15 and have apertures 21 and 22 for receiving locking pins 19*a* and 20*a* of bracing bar locks 19 and 20. The locking pins 19*a* or 20*a* are slidably mounted within mounting brackets 19*c* or 20*c*. A retention spring 19*b* or 20*b* between the mounting brackets 19*c* or 20*c* bias the locking pins into an outward projecting position for engaging the apertures 21 or 22. Handle portions 19*d* or 20*d* on the locking pins 19*a* or 20*a*** facilitate retraction of the locking pins.

An alignment pin 23 at an intermediate point on the horizontal flange **16*b* aligns with an aperture 24 in the floor 13 to facilitate alignment of the bracing bar on the floor 13, which in turn aligns aperture 29 of vertical flange 16*a* with aperture 26 of door 12**.

Provision of bracing bar locks 19 and 20 having easily retractable locking pins permits simple installation of the bracing bar 16 between the corner posts 17 and 18. The bracing bar locks also insure that the bar 16 is vertically retained when the bar 16 secures overhead doors. Consequently, the apparatus 10 is directly adapted for use with either horizontal or vertically swinging doors.

A locking device holder 25 is provided at an intermediate point on the vertical flange **16*a* of bar 16. An aperture 29 (as seen most clearly in FIG. 3) in the vertical flange 16*a* is aligned adjacent the locking device holder 25**.

As shown most clearly in FIGS. 2 and 3 a retaining member 27 is provided having a flagged end **27*a* and a free end portion 28 comprised of a cable or rod. The end portion 28 is inserted through an aperture 26 in the door 12 to slidably engage through the aperture 29 and enter the locking device holder 25**.

As shown in FIG. 3, a locking device 48 is enclosed within the locking device holder 25. A cylindrical body member 46 having a threaded top 47 centers the locking device 48 over the aperture 29. Threaded portions 49 and 50 mate to permit the top 47 to screw onto the cylindrical body member 46. As the free end 28 of the retainer member 27 is pushed through the locking device 48, the end 28 emerges through an aperture 45 in the top 47 of the locking device holder 25.

As shown in FIGS. 4 and 5, the locking shell of the locking device 48 includes a generally cylindrical shell member 51 with a conical front portion formed with a central opening 52 at a first end which opens into a larger opening 37. The opening 52 at the end 32 of the shell is large enough to allow the free end 28 of the retaining member 27 to pass through. A retainer member 33 having a central opening 34 is secured in the body member 51 adjacent an end 31 as shown. The internal space of the locking shell is formed with a cylindrical opening 36 and a tapered opening 35. The cylindrical opening 34 is adjacent the end 31 and joins to the tapered opening 35 which extends to the end 37. As shown in FIG. 5, the conical tapered opening 35 extends from 36 and generally by transition goes into a triangular shaped opening before point 37.

A cluster of balls 38, 39 and 40 are held by a ball retainer 41 which has a central opening through which the balls extend and through which the cable end 28 can extend. The retainer 41 is also formed with openings such that the balls 38, 39 and 40 can engage the inner surface of the locking shell as shown in FIGS. 4 and 5.

A coil spring 42 has a first end 43 which bears against the end plate 33 and a second end 44 which bears against the ball retainer 41 so as to bias it to the left relative to FIG. 4.

The diameter of the cylindrical portion 36 of the internal opening of the locking shell is chosen such that when the free end 28 of the retaining member 27 is inserted through the locking shell, the balls will allow relatively free passage of the free end of the cable or rod to the right as shown in FIG. 4. The tapered portion between points 36 and 37 of the internal opening is such that upon the application of tension to the cable free end 28, the free end moves to the left relative to the shell 51 and the balls 38, 39 and 40 will be cammed by the surface between the points 37 and 36 towards the center line of the cable 28 thus locking the cable so that it cannot be withdrawn when pulled to the left relative to FIG. 4.

In operation, the free end 28 of the retaining member 27 is inserted through the opening 26 in the door 12 and opening 51 in the vertical flange **16*a* until it enters the opening 52 of the locking device 48 to bear against the balls 38, 39 and 40. As the end 28 is further inserted into the locking shell it pushes the balls in the ball retainer 41 to the right relative to FIG. 4, thus allowing the balls 38, 39 and 40 to move away from the cable or rod 28 until the balls reach the point 36 illustrated in FIG. 4. The cable or rod 28 can freely pass through the space between the balls and out the opening 34 of the retaining wall 33. Any attempt to move the free end 28 of the retaining member 27 to the left relative to FIG. 4 will immediately cause the balls 38, 39 and 40 to move on the internal conical and triangular shaped surface between points 36 and 37, thus moving the balls together and applying pressure on the free end 28 so as to lock it from movement to the left relative to FIG. 4. This corresponds to pulling the flag portion 27*a* of the retaining member 27 outward from the doors 11 and 12**.

As will be obvious from the above description, removal of the retaining member 27 is not possible after it has been installed. Furthermore, if the flag portion **27*a* of the retaining member abuts the door 12, powerful cutting tools will be necessary to disengage the security device. Consequently, any unauthorized entry into the storage area through the doors 11 and 12 will require destruction of the retaining member 27**. Such destruction will provide ample evidence of unauthorized entry.

Figure 6:
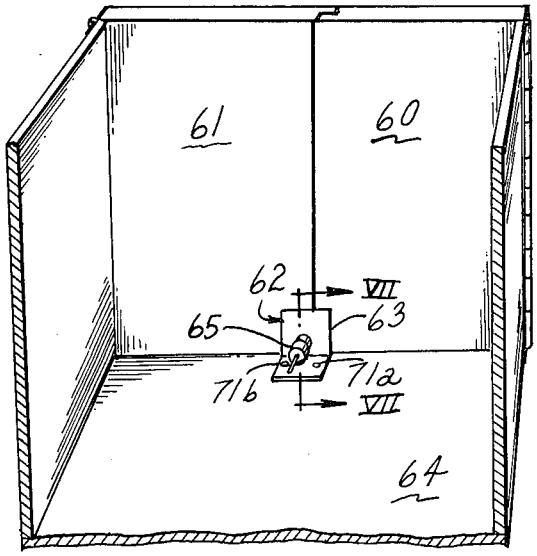
FIG. 6 is a perspective view of a bracing and securing apparatus for horizontally swinging doors.
Figure 7:
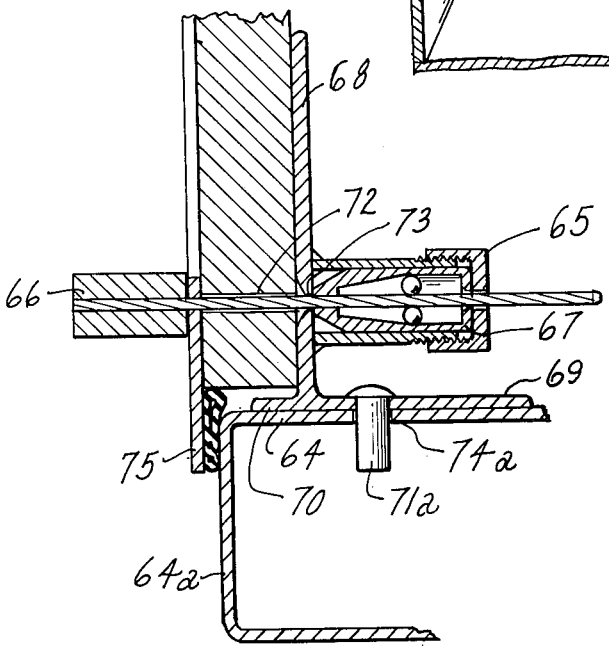
FIG. 7 is a partial cross-sectional view taken along line VII—VII of FIG. 6.
Figure 8:
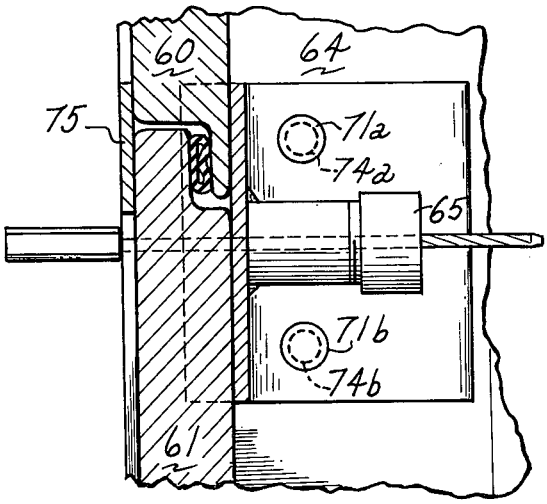
FIG. 8 is a fragmentary plan view of the apparatus of FIG. 6.

As described previously, bracing and securing apparatus 10 illustrated in FIG. 1 is useful for both vertically swinging or overhead doors and horizontally swinging doors. An embodiment of the invention for primary use with horizontally swinging doors is illustrated in FIGS. 6 through 8. Another embodiment of the invention primarily useful with overhead doors is illustrated in FIGS. 9 through 11.

As shown in FIG. 6, overlapping horizontal swinging doors 60 and 61 may be secured with a bracing and securing apparatus 62. The apparatus 62 comprises a short L-shaped bracing bracket 63 which abuts the door(s) at floor level 64. A locking device holder 65 is mounted on the L-shaped bracket 63 and a retaining member 66 and locking device 67 are provided as described previously.

The L-shaped bracket 63 has a vertical flange 68 and horizontal flange 69. Adjacent the horizontal flange 69 a lip 70 is provided which fits beneath the bottoms of the swinging doors 60, 61 to prevent upward lifting of the bracket 63. Fixed alignment pins **71*a* and 71*b* received in floor apertures 74*a* and 74*b* prevent lateral movement of the bracket 63 and also align an aperture 73 in the vertical flange with the door aperture 72 to permit engagement of the retaining member 66 through these apertures into the locking device 67. A vertical door flange 75 is provided on the exterior portion of the doors 60, 61 such that the flange abuts a rear apron 64*a*** of the floor or door sill.

Figure 9:
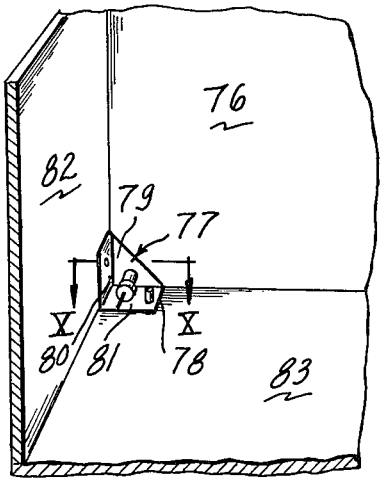
FIG. 9 is a fragmented perspective view of a bracing and securing apparatus for overhead doors.
Figure 10:
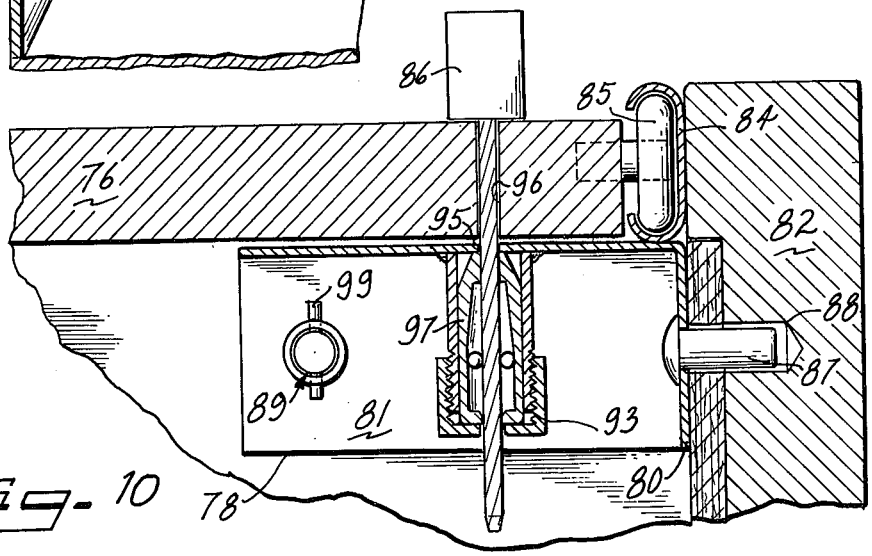
FIG. 10 is a partial cross-sectional view taken along line X—X of FIG. 9 for a right-hand embodiment of the apparatus.
Figure 11:
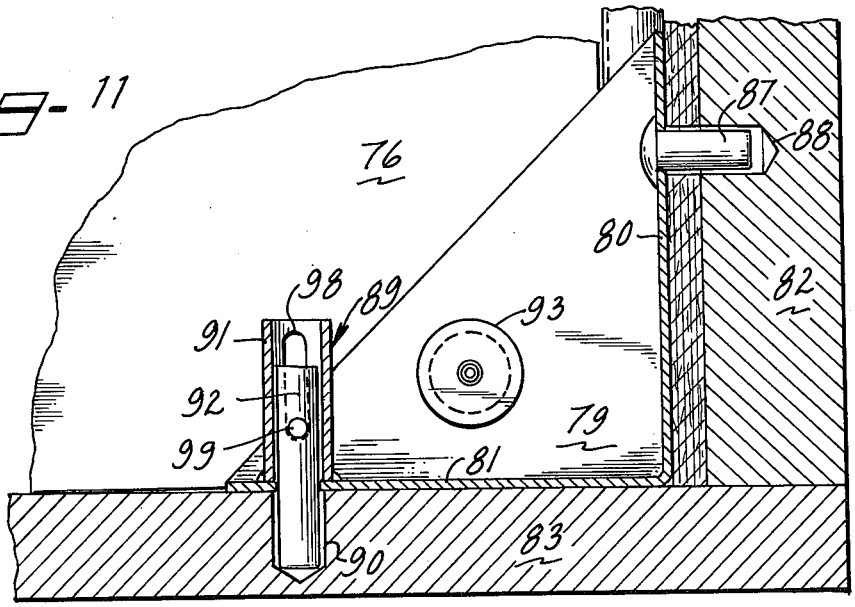
FIG. 11 is a fragmentary rear view of the apparatus of FIG. 9.

As shown in FIG. 9 and more particularly in FIGS. 10 and 11, an overhead door 76 may be locked by use of a bracing and securing apparatus 77. The apparatus 77 comprises a corner bracket 78 having a triangular portion 78 which abuts against the overhead door 76. A vertical portion 80 abuts against a side wall 82 and a horizontal portion 81 against a floor 83. The overhead door 76 is guided by a track 84 by use of rollers 85. The apparatus may be mounted at the right or left-hand sides of the door.

A locking device holder 93 is mounted on the triangular portion 79 adjacent an aperture 95. When the door is closed, aperture 95 aligns with an aperture 96 in the door to permit a retaining member 86 to pass through the apertures and engage a locking device 97 within the locking device holder 93.

The corner bracket 78 is retained in position by a stationary pin 87 which engages a side wall aperture 88. A retractable pin means 89 is provided on the horizontal or floor portion 81 of the bracket 78 to permit removal and installation of the bracket. The retractable pin means 89 comprises a pin 92 movable within a guide 91. A lifting arm 99 connected to the pin 92 moves within a slot 98 of the guide 91. Pin 92 engages an aperture 90 in the floor 83.

It is seen that this invention provides a new and novel brace and security apparatus for a storage entranceway and although it has been described with respect to preferred embodiments, it is not to be so limited and changes and modifications may be made which are within the full intended scope of the invention as defined by the appended claims.

I claim as my invention:

1. A door brace and security apparatus adapted for a storage area closure means comprising:

a. a storage area defined by wall and floor surfaces and having access thereto controlled by a closure means adjacent the wall and floor surfaces;

b. bracing means connected by detachable connecting means to at least one of the wall and floor surfaces within the storage area adjacent the closure means, said connecting means retaining the bracing means in position prior to locking to the closure means;

c. a retaining member having one free end and a flag member attached to the other end;

d. aperture means in the closure means through which said retaining member free end is positioned; and e. a locking means mounted on said bracing means for slidably engaging said retaining member free end when said free end is positioned through said closure means aperture and pushed into said locking means, and for locking to said retaining member free end when said retaining member is pulled away from said locking means, said locking means being aligned with said aperture means when said closure means is closed.

2. The apparatus of claim 1 in which said locking means is retained in a locking means holder mounted on said bracing means.

3. A door brace and security apparatus adapted for a storage area closure means comprising:

a. a storage area defined by wall and floor surfaces and having access thereto controlled by a closure means adjacent the wall and floor surfaces;

b. bracing means connected by detachable connecting means to at least one of the wall and floor surfaces within the storage area adjacent the closure means;

c. a retaining member having one free end and a flag member attached to the other end;

d. aperture means in the closure means through which said retaining member free end is positioned;

e. a locking means mounted on said bracing means for slidably engaging said retaining member free end when said free end is positioned through said closure means aperture and pushed into said locking means, and for locking to said retaining member free end when said retaining member is pulled away from said locking means, said locking means being aligned with said aperture means when said closure means is closed;

f. said locking means being retained in a locking means holder mounted on said bracing means; and g. said locking means holder comprising a cylindrical member having one end mounted to the bracing means and the other end closed by a threaded cap.

4. The apparatus of claim 1 in which said bracing means comprises a bar supported between opposite walls of the storage area by the detachable connecting means, said connecting means retaining the bar in position independently of the retaining member prior to locking.

5. The apparatus of claim 1 in which said detachable connecting means comprises two spring loaded locking pins.

6. A door brace and security apparatus adapted for a storage area closure means comprising:

a. a storage area defined by wall and floor surfaces and having access thereto controlled by a closure means adjacent the wall and floor surfaces;

b. bracing means connected by detachable connecting means to at least one of the wall and floor surfaces within the storage area adjacent the closure means;

c. a retaining member having one free end and a flag member attached to the other end;

d. aperture means in the closure means through which said retaining member free end is positioned; and e. a locking means mounted on said bracing means for slidably engaging said retaining member free end when said free end is positioned through said closure means aperture and pushed into said locking means, and for locking to said retaining member free end when said retaining member is pulled away from said locking means, said locking means being aligned with said aperture means when said closure means is closed; and f. said locking means comprising a locking shell with interior sloping walls and having a plurality of balls held within the locking shell by a spring loaded retainer.

7. The apparatus of claim 1 in which said bracing means comprises an L-shaped bracket which is retained in position by at least one retaining pin received in a floor of said storage area, said bracket having a length which is substantially less than the distance between side walls at sides of the closure means, said closure means comprising horizontally swinging doors, and said bracing means being retained in position by the connecting means independently of the retaining member prior to locking.

8. A door brace and security apparatus adapted for a storage area closure means comprising:

a. a storage area defined by wall and floor surfaces and having access thereto controlled by a closure means adjacent the wall and floor surfaces;

b. bracing means connected by detachable connecting means to at least one of the wall and floor surfaces within the storage area adjacent the closure means;

c. a retaining member having one free end and a flag member attached to the other end;

d. aperture means in the closure means through which said retaining member free end is positioned; and e. a locking means mounted on said bracing means for slidably engaging said retaining member free end when said free end is positioned through said closure means aperture and pushed into said locking means, and for locking to said retaining member free end when said retaining member is pulled away from said locking means, said locking means being aligned with said aperture means when said closure means is closed; and f. said bracing means comprising a corner bracket, said corner bracket having a horizontal portion with a retractable pin received in a floor of said storage area adjacent the junction of an overhead door and side wall of the storage area, a fixed pin being provided on a vertical portion of the bracket which is received by an aperture in said side wall.

9. A method for bracing and securing an entrance door to a storage area comprising the steps of:

a. detachably connecting a bracing means in said storage area adjacent said door, said bracing means having a locking device connected thereto for slidably engaging a locking member pushed into said locking device and locking to said locking member when said member is pulled out of said device, said bracing means being retained in position independently of said locking device;

b. closing said door; and c. slidably engaging a free end of a locking member through an aperture in said door and pushing the free end into said locking device.

10. The method of claim 9 including the step of inserting the locking device into a locking device holder on said bracing means.

11. The method of claim 9 in which said locking member is pushed into said locking device until a flag on said locking member abuts the door.

* * * * *